United States Patent [19]

Yasuda et al.

[11] Patent Number: 4,460,671

[45] Date of Patent: Jul. 17, 1984

[54] PRESS FIXING TYPE ELECTROSTATIC RECORDING MATERIAL

[75] Inventors: Tokuro Yasuda; Akinori Oka, both of Yonago, Japan

[73] Assignee: Oji Paper Co., Ltd., Tokyo, Japan

[21] Appl. No.: 428,794

[22] Filed: Sep. 30, 1982

Related U.S. Application Data

[63] Continuation of Ser. No. 203,994, Nov. 4, 1980, abandoned.

[30] Foreign Application Priority Data

Nov. 8, 1979 [JP] Japan ..... 54-143886

[51] Int. Cl.[3] ..... G03G 13/20; G03G 13/22

[52] U.S. Cl. ..... 430/98; 428/324; 428/328

[58] Field of Search ..... 430/98, 99, 124, 126; 428/328, 511; 427/121

[56] References Cited

U.S. PATENT DOCUMENTS

| | | | |
|---|---|---|---|
| 3,674,477 | 7/1972 | Carlson | 430/89 |
| 3,944,705 | 3/1976 | Fujioka et al. | 427/121 X |
| 3,998,987 | 12/1976 | Kirigaya et al. | 427/121 X |
| 4,241,134 | 12/1980 | Burwasser | 427/121 X |
| 4,259,425 | 3/1981 | Serlin | 430/98 X |
| 4,296,171 | 10/1981 | Imai | 428/511 X |
| 4,336,306 | 6/1982 | Fellows | 427/121 X |

*Primary Examiner*—Roland E. Martin, Jr.

*Attorney, Agent, or Firm*—Armstrong, Nikaido, Marmelstein & Kubovcik

[57] ABSTRACT

A press-fixing type electrostatic recording material having an excellent recording property comprises a substrate having a low surface resistivity of $10^9$ ohms or less and an electrostatic recording resinous layer which is formed on at least one surface of the substrate and which comprises a polyester resin and an anhydrous aluminum silicate uniformly mixed with the polyester resin.

6 Claims, No Drawings

PRESS FIXING TYPE ELECTROSTATIC RECORDING MATERIAL

This is a continuation, of application Ser. No. 203,994, filed Nov. 4, 1980, abandoned.

FIELD OF THE INVENTION

The present invention relates to an electrostatic recording material exhibiting an excellent recording property. More particularly, the present invention relates to a novel press fixing type electrostatic recording material exhibiting an excellent recording property which comprises a substrate and an electrostatic recording resinous layer, comprising a polyester resin and an anhydrous aluminum silicate uniformly mixed with the polyester resin.

BACKGROUND OF THE INVENTION

It is known that electrostatic latent images formed on an electrostatic recording resinous layer can be dry-developed with a toner and the toner images can be fixed under pressure. This type of fixing method is called a press fixing method. The press fixing method has been developed next to a heat fixing method and a dry fixing method. The heat fixing method requires an electric heating device and therefore, is accompanied by a high consumption of electric power. Also, the dry fixing method requires a drying apparatus which results in an increase in the cost of fixing operation. In addition, the dry fixing method is accompanied by the evaporation of an organic solvent which is used in the development process. The evaporated organic solvent may cause public pollution problems. In contrast, the press fixing method comprises passing a recording paper after being subjected to a dry development through a pair of rolls under pressure. Therefore, the press fixing method is free of the above mentioned disadvantages encountered in the heat fixing method and the dry fixing method. In addition, the use of the press fixing method makes it possible to reduce the size of an electrostatic recording apparatus proper and to increase the speed of fixing. Accordingly, the press fixing method is a better fixing method. However, when the press fixing method is applied to a conventional electrostatic recording material, the fixing of the resultant recorded images in unsatisfactory. That is, in some cases, when the toner images are rubbed by hand, they easily come off the recording material. For this reason, several attempts have been made to improve the press fixing property of electrostatic recording materials designed for use in press fixing methods. For example, Japanese Patent Application Laid-open (Kokai) No. 52-156628 (1977) discloses the use of a non-crystalline resin having a second order transition temperature of from −40° to +40° C. as a resin for an electrostatic recording resinous layer. Also, Japanese Patent Application No. 54-16078 (1979) discloses an electrostatic recording resinous layer composed of two layers the lower layer of which has a higher content of a resin to secure an excellent electrostatic recording property thereof and the upper layer of which has a higher content of a pigment to secure an excellent press fixing property of the resinous layer. This two-layered structure is designed for simultaneously improving the electrostatic recording property of the resinous layer and the press fixing property of the resinous layer.

The use of a soft resin results in an improvement in the press fixing property of the resinous layer due to its high adhesive action. It is inevitable, however, that toners are deposited on the non-image areas, which result in a fog in the recorded images. On the other hand, the two-layered structure is effective for improving the press fixing property of the resinous layer. However, this approach is accompanied by an increase in the production steps, adding to the production cost.

The resin which has been heretofore used in forming an electrostatic recording resinous layer for the conventional press fixing type electrostatic recording material includes polystyrene, polyvinyl chloride, polyvinyl acetate, a vinyl chloride-vinyl acetate copolymer, polymethyl methacrylate, polyethylene, an ethylene-vinyl acetate copolymer, polyacrylic acid esters, silicon resins, epoxy resins, and polyvinyl butyral. Also, the pigment to be incorporated into the resin includes inorganic pigments such as zinc oxide, titanium dioxide, clay, calcium carbonate, white lead, lithopone, barium sulfate, barium titanate, talc, aluminum hydroxide, zinc sulfide and silica and organic pigments such as finely divided proteins, finely divided celluloses, finely divided polyethylene and finely divided polyvinyl chloride. In the case where a combination of these conventional resins and pigments is used to form an electrostatic recording resinous layer, the only way to improve the press fixing property of the resinous layer was to increase the content of the pigment contained in the electrostatic recording resinous layer. However, a high content of pigment results in a deterioration in the insulation resistance of the electrostatic recording resinous layer (dielectric layer) and an increase in the moisture absorbing property thereof, which causes the chargeability of the resinous layer to be extremely poor and particularly, causes the resultant image recorded in a highly humid atmosphere to exhibit an extreme reduction in the density thereof. Accordingly, even if the press fixing property of the resinous layer could be improved, the resultant recorded images would be of no practical use. Therefore, the means of increasing the content of the pigment contained in the electrostatic recording resinous layer is not practically useful.

The inventors have made earnest studies to clarify the reason why increasing the content of the pigment contained in the electrostatic recording resinous layer results in an excellent press fixing property. As a result, the inventors have found that the excellent press fixing property is attributable to a finely rugged structure of the surface of the electrostatic recording resinous layer which is formed when the content of the pigment is increased. Then, the inventors made further studies to develop a means by which such a finely rugged structure could be formed without increasing the content of the pigment. As a result, the inventors found that the above mentioned object could be attained by using a polyester as a resin for an electrostatic recording resinous layer and an anhydrous aluminum silicate as a pigment therefore. On the basis of this knowledge, the inventors have accomplished this invention.

That is, in accordance with the present invention, a finely rugged structure of the surface of an electrostatic recording resinous layer for a press fixing type electrostatic recording material is formed by using a novel combination of a polyester and an anhydrous aluminum silicate in forming the resinous layer.

DISCLOSURE OF THE INVENTION

An object of the present invention is to provide a press fixing type electrostatic recording material exhibiting an excellent press fixing property and a recording property.

The press fixing type electrostatic recording material according to the present invention comprises a substrate having a lower surface resistivity of $10^9$ ohms or less and an electrostatic recording resinous layer formed on at least one surface of the substrate and comprising a polyester resin and an anhydrous aluminum silicate uniformly mixed with the polyester resin.

When the surface of the electrostatic recording resinous layer comprising a polyester resin and an anhydrous aluminum silicate uniformly mixed with the polyester resin is observed under a scanning electron microscope, it is found to have a finely rugged surface structure. This finely rugged surface structure is effective for improving the press fixing property of the resinous layer and thus, the recording property thereof. The finely rugged surface structure makes it possible to cause developing particles to be embedded within the electrostatic recording resinous layer (i.e. the dielectric layer) and to cause the contact area between the developing particles and the electrostatic recording resinous layer to be increased. It is considered that the press fixing property of the resinous layer can be enhanced by these features.

DETAILED DESCRIPTION OF THE INVENTION

In the present invention, a substrate exhibiting a relatively low surface resistivity of $10^9$ ohms or less, usually, from $10^5$ to $10^9$ ohms is used. The substrate may be made of paper or a plastic film. An electrostatic recording resinous layer may be coated on one or both surfaces of the substrate.

The polyester constituting one component of the electrostatic recording resinous layer (dielectric layer) of the present invention can be selected from high molecular weight linear polyesters exhibiting a high solubility in a solvent which consists of a multi-component copolymer (random copolymer) prepared by subjecting several kinds of a dibasic acid and several kinds of a dihydric alcohol to a polycondensation reaction.

The dibasic acid and the dihydric alcohol which may be used in the preparation of the polyester may be selected, for example, from those indicated in Table 1, below.

TABLE 1

| Dibasic acid | Dihydric alcohol |
|---|---|
| HOOCCOOH | $HO(CH_2)_2OH$ |
| $HOOC(CH_2)_2COOH$ | $HO(CH_2)_3OH$ |
| $HOOC(CH_2)_4COOH$ | $HO(CH_2)_4OH$ |
| $HOOC(CH_2)_8COOH$ | $HOH_2C-C(CH_3)_2-CH_2OH$ |
| $HOOC(CH_2)_{10}COOH$ | $HOH_2CH_2COCH_2CH_2OH$ |
| 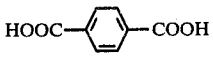 | $HO(C_2H_4O)_3H$ |
| 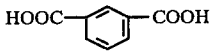 | $HO(C_2H_4O)_nH$ |

TABLE 1-continued

| Dibasic acid | Dihydric alcohol |
|---|---|
| 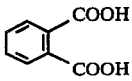 | 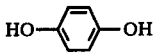 |
| 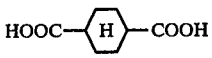 | 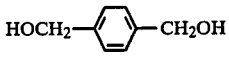 |
| 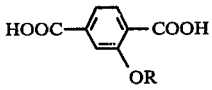 | |
| 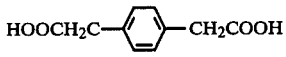 | |
| 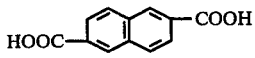 | |

The polyester resin may be added with an additional resin, for example, polymethyl methacrylate, in a ratio of the polyester resin to the additional resin of 50:50 or more.

The anhydrous aluminum silicate contained in the electrostatic recording resinous layer of the present invention is in the form of finely divided particles. The particle size of the anhydrous aluminum silicate particles is not particularly critical. However, the silicate particles must have a particle size suitable for providing, in cooperation with the polyester resin, a finely rugged structure on the surface of the electrostatic recording resinous layer. Usually, it is preferable that the anhydrous aluminum silicate has an average particle size of about 1.5 microns. The configuration of the anhydrous aluminum silicate particles is not particularly critical. The anhydrous aluminum silicate particles may be amorphous or crystalline, i.e. in the form of a thin flat plate or a thin flake. The configuration of these particles has no substantial effect on the formation of the finely rugged structure on the surface of the electrostatic recording resinous layer. Accordingly, the configuration of these particles has no substantial effect on the press fixing property of the resultant resinous layer and the recording property thereof. The anhydrous aluminium silicate may be added with an additional pigment, for example, calcium carbonate or clay, in a ratio of anhydrous aluminum silicate to additional pigment of 50:50 or more.

The electrostatic recording resinous layer of the present invention has a ratio of resin to pigment of about 80:20 to 50:50. The electrostatic recording resinous layer may contain an additional resin other than the polyester and an additional pigment other than the anhydrous aluminum silicate, provided that these additional materials do not hinder the object of the present invention.

As is apparent from Table 2 described hereinafter, the press fixing type electrostatic recording material of the present invention exhibits an extremely excellent press fixing property as compared with a comparative press fixing type electrostatic recording material in which no combination of the polyester and the anhydrous aluminum silicate particles is used. Also, the electrostatic recording material of the present invention exhibits a higher image density and a lower reduction in image density at a high relative humidity than the comparative electrostatic recording material. In the case of the electrostatic recording material of the present invention, even if the content of the pigment contained in the electrostatic recording resinous layer is low, the press fixing property of the resinous layer is satisfactory. On the other hand, if the content of the pigment is high, the press fixing property of the resinous layer is further enhanced in accordance with an increase in the content of the pigment. However, even in this case, the resultant images have a high enough density to be of practical use. In this manner, because the electrostatic recording material of the present invention exhibits an excellent press fixing property, the recording property thereof is also excellent.

In addition, the electrostatic recording material of the present invention suffers from no disadvantage, such as being cloudy as is usual with the conventional electrostatic recording material. Also the electrostatic recording material of the present invention can be produced without an increase in the number of the production steps.

The present invention will be further illustrated by the examples set forth below, which are provided for the purpose of illustration and should not be interpreted as in any way limiting the scope of the present invention.

In the example, the following appratuses were used.

Developing apparatus:

a modified facsimile, manufactured by Nippon Denki K. K.

Fixing appratus:

a calender, operated at a linear pressure of 35 kg/cm, manufactured by Ōji Seishi K. K.

Density determining appratus:

MULTIPLIER PHOTOMETER, manufactured by Tokyo Koden K. K.

The press fixing property of the electrostatic recording material was determined in accordance with the following method.

A sample of an electrostatic recording material was subjected to a latent image forming procedure and the resultant latent images formed on the surface of the electrostatic recording resinous layer were developed with a toner. Then, the toner images were fixed under pressure. The density ($D_0$) of the fixed images was determined. Then, a cellotape was adhered under pressure onto the image-areas and, then, the cellotape was peeled off from the image-areas. The density ($D_1$) of the image areas from which the cellotape was peeled off was determined. A percentage of press fixing of the electrostatic recording material was calculated in accordance with the equation:

$$\text{Percentage of press fixing} = \frac{D_1}{D_0} \times 100\ (\%)$$

Example 1 through 16 and Comparison Examples 1 through 15

In each of the Examples 1 through 16 and Comparison Examples 1 through 15, a paper substrate was prepared by impregnating a high grade paper sheet having a basic weight of 50 g/m$^2$ with an electrically conductive material consisting of a polyelectrolyte.

Then, the resin and the pigment, respectively, indicated in Table 2, in the ratio indicated in Table 2, were introduced into an attritor. The mixture was milled for 1 hour to uniformly disperse the pigment throughout the resin, thereby producing a coating composition.

The coating composition was applied onto the paper substrate at a coverage of from 3 to 10 g/m$^2$ by means of a Meyer rod applicator to produce an electrostatic recording material.

The electrostatic recording material was subjected to an electrostatic recording operation, by using a pulse signal of 50 μsec at a negative voltage of −700 V to record latent images on the material. Then, the latent images were developed with a one component type magne-dry toner. Subsequently, the electrostatic recording material was passed through a pair of rolls made of steel at a linear pressure of 35 kg/cm to fix the toner images formed on the resinous layer of the recording material.

The density and the press fixing property of the recording material were determined at a relative humidity of 45% and 80%, respectively.

TABLE 2

| Example No. | Resin | Pigment | Resin/Pigment | Density 45% RH | Density 80% RH | Press fixing Property (%) |
|---|---|---|---|---|---|---|
| 1 | *1 Polyester | *3 Anhydrous aluminum silicate | 80/20 | 1.48 | 1.26 | 60 |
| 2 | | | 70/30 | 1.40 | 1.21 | 72 |
| 3 | | | 60/40 | 1.27 | 1.10 | 86 |
| 4 | | | 50/50 | 1.01 | 0.85 | 92 |
| 5 | *1 Polyester | *4 Anhydrous aluminum silicate | 80/20 | 1.25 | 1.12 | 65 |
| 6 | | | 70/30 | 1.18 | 1.03 | 74 |
| 7 | | | 60/40 | 1.09 | 0.98 | 85 |
| 8 | | | 50/50 | 0.95 | 0.76 | 94 |
| 9 | *1 Polyester | *5 Anhydrous aluminum silicate | 70/30 | 1.26 | 0.98 | 73 |
| 10 | | *6 " | " | 1.35 | 1.11 | 75 |
| 11 | *2 Polyester | *3 " | " | 1.25 | 1.02 | 69 |
| | *1 Polyester/vinyl chloride copolymer | *3 Anhydrous aluminum silicate/calcium carbonate | | | | |
| 12 | 80/20 | 70/30 | 70/30 | 1.53 | 1.26 | 65 |
| 13 | 70/30 | " " | 1.48 | 1.34 | 68 | |
| 14 | 60/40 | " " | 1.62 | 1.21 | 62 | |
| | *1 Polyester/polymethyl methacrylate | *3 Anhydrous aluminum silicate/clay | | | | |
| 15 | 90/10 | 70/30 | 70/30 | 1.25 | 1.08 | 75 |
| 16 | " | 60/40 | " | 1.18 | 1.03 | 70 |
| Comparison | | | | | | Press fixing |

TABLE 2-continued

| Example No. | Resin | Pigment | Resin/Pigment | Density 45% RH | Density 80% RH | property (%) |
|---|---|---|---|---|---|---|
| 1 | *1 Polyester | Calcium carbonate | 80/20 | 1.51 | 1.29 | 12 |
| 2 | | | 60/40 | 1.32 | 1.11 | 35 |
| 3 | | | 40/60 | 0.51 | 0.21 | 68 |
| 4 | Polymethyl methacrylate | *3 Anhydrous aluminum silicate | 80/20 | 1.24 | 1.01 | 20 |
| 5 | | | 60/40 | 1.01 | 0.85 | 48 |
| 6 | | | 40/60 | 0.23 | 0.05 | 79 |
| 7 | Polymethyl methacrylate | Calcium carbonate | 80/20 | 1.36 | 1.15 | 15 |
| 8 | | | 60/40 | 1.04 | 0.87 | 27 |
| 9 | | | 40/60 | 0.33 | 0.11 | 70 |
| 10 | Polyethylene | *4 Anhydrous aluminum silicate | 80/20 | 1.41 | 1.01 | 25 |
| 11 | | | 60/40 | 1.15 | 0.65 | 47 |
| 12 | | | 40/60 | 0.48 | 0.23 | 82 |
| 13 | Polyvinylidene | Calcium carbonate | 80/20 | 1.25 | 1.03 | 17 |
| 14 | | | 60/40 | 1.03 | 0.75 | 30 |
| 15 | | | 40/60 | 0.29 | 0.15 | 73 |

Note:
*1 (polyester resin A200, a trade name, manufactured by AKUZO Limited)
*2 (polyester resin Byron #200, a trade name, manufactured by Toyoboseki K. K.) Vinyl chloride copolymer VAGH, a trade name, manufactured by Union Carbide Corporation Polymethyl methacrylate: Thermorack EM, a trade name, manufactured by Soken Kagaku Co. Polyethylene: Easter Bond V513, a trade name manufactured by Shoei Kagaku Co. Polyvinylidene chloride: Aron 321, a trade name manufactured by Toa Gosei Kagaku Co.
*3 Anhydrous aluminum silicate: ANSILEX 93, a trade name, manufactured by Engel Hard Minerals & Chemicals Corp.
*4 Anhydrous aluminum silicate: Optiwhite, a trade name, a particle size = 1.4 microns, amorphous, manufactured by Barges Co.
*5 Anhydrous aluminum silicate: Aicecup K, a trade name, a particle size = 1.0 micron, thin plate form, manufactured by Barges Co.
*6 Anhydrous aluminum silicate: Aiceberg, a trade name, a particle size = 1.4 microns, thin flake form, manufactured by Barges Co. Calcium carbonate: NCC-P, a trade name, manufactured by Shiraishi Calcium Co. Clay: SSW, a trade name, manufactured Nozaki Clay Co.

In the electrostatic recording materials of Example 1 through 16 according to the present invention, the images were formed in a high color density, and the images exhibited a very low reduction therein even at a higher relative humidity. Even if the press fixed images formed on the material were rubbed with the fingers, no disappearance of the images occurred and the background thereof was not spoiled.

In the electrostatic recording materials of Comparison Examples 1, 2, 4, 5, 7, 8, 10, 11, 13 and 14, the images could be formed in a high color density and the images exhibited a very low reduction therein even at a higher relative humidity. However, in these cases when the press fixed images formed on the material were rubbed with the fingers, a portion of the images disappeared and the fingers were soiled by the toners. Although the electrostatic recording materials of Comparison Examples 3, 6, 9, 12 and 15 exhibited excellent press fixing property, the density of these images was low and it was extremely low at a higher relative humidity.

Observation of the dielectric layers of the electrostatic recording materials shown in Table 2 by a scanning electron microscope revealed that the dielectric layers of the electrostatic recording materials of Example 1 through 16 and the electrostatic recording materials exhibiting excellent press fixing property of Comparison Examples 3, 6, 9, 12 and 15 had a finely rugged structure on the surface thereof, while the dielectric layers of the electrostatic recording materials exhibiting poor fixing property of Comparison Examples 1, 2, 4, 5, 7, 8, 10, 11, 13 and 14 had a relatively flat surface.

In addition, the percentage of press fixing of the electrostatic recording materials of Examples 1 through 16 and Comparison Examples 1, 2, 4, 5, 7, 8, 10, 11, 13 and 14 was calculated by the above mentioned equation.

As a result, it was found that the percentage of press fixing of the electrostatic recording materials of comparison Examples was in a range of from 12 to 48%, while the percentage of press fixing of the electrostatic recording material of Examples 1 through 16 according to the present invention was 60% or more. Therefore, it is clear that the electrostatic recording material of the present invention exhibits a significantly improved press fixing property over the comparative electrostatic recording material.

Generally, it is considered that an electrostatic recording material exhibiting a percentage of press fixing of 60% or more is satisfactory for practical use, and an electrostatic recording material exhibiting a percentage of press fixing of 75% or more is particularly excellent.

We claim:

1. A method for forming and fixing toner images on an electrostatic recording material, comprising forming electrostatic latent images on an electrostatic recording material which comprises a substrate having a low surface resistivity of $10^9$ ohms or less and an electrostatic recording resinous layer formed on at least one surface of said substrate and comprising a polyester resin and an anhydrous aluminum silicate which is amorphous or in the form of thin flat plates or thin flakes and which is uniformly mixed with said polyester resin, the ratio in weight of said polyester resin to said anhydrous aluminum silicate being in the range of from 80:20 to 50:50 wherein said electrostatic recording resinous layer is provided with a finely rugged structure on the surface thereof;

developing said latent images with a toner; and press-fixing the resultant toner images on the surface of said electrostatic recording resinous layer, under pressure.

2. The method as claimed in claim 1, wherein said substrate has a surface resistivity of from $10^5$ to $10^9$ ohms.

3. The method as claimed in claim 1, wherein said polyester is a high molecular weight, multi-component linear copolyester exhibiting a high solubility in a solvent.

4. The method as claimed in claim 1, wherein said anhydrous aluminum silicate has an average particle size of about 1.5 microns.

5. The method as claimed in claim 1, wherein said anhydrous aluminum silicate is added with an additional pigment in a ratio in weight of said anhydrous aluminum silicate to said additional pigment of 50:50 or more.

6. The method as claimed in claim 1, wherein said polyester resin is added with an additional resin in a ratio in weight of said polyester resin to said additional resin of 50:50 or more.

* * * * *